US011065640B2

(12) United States Patent
Antonie

(10) Patent No.: US 11,065,640 B2
(45) Date of Patent: Jul. 20, 2021

(54) SYSTEM, METHOD, AND APPARATUS FOR HOT MELT ADHESIVE APPLICATION

(71) Applicant: Adhezion, Inc., Rockford, MI (US)

(72) Inventor: Mike Antonie, Madison Heights, MI (US)

(73) Assignee: Adhezion, Inc., Rockford, MI (US)

( * ) Notice: Subject to any disclaimer, the term of this patent is extended or adjusted under 35 U.S.C. 154(b) by 139 days.

(21) Appl. No.: 16/162,989

(22) Filed: Oct. 17, 2018

(65) Prior Publication Data

US 2020/0122189 A1 Apr. 23, 2020

(51) Int. Cl.

| | |
|---|---|
| ***B05C 11/10*** | (2006.01) |
| ***B05C 17/005*** | (2006.01) |
| ***B05C 5/00*** | (2006.01) |
| ***B05B 7/04*** | (2006.01) |
| ***B05B 7/06*** | (2006.01) |
| ***B05B 7/08*** | (2006.01) |
| *B05B 1/04* | (2006.01) |

(52) U.S. Cl.

CPC ..... *B05C 11/1042* (2013.01); *B05B 7/0416* (2013.01); *B05B 7/066* (2013.01); *B05B 7/0815* (2013.01); *B05C 5/001* (2013.01); *B05C 17/00526* (2013.01); *B05C 17/00546* (2013.01); *B05B 1/042* (2013.01); *B05B 1/044* (2013.01)

(58) Field of Classification Search

CPC ..... B05C 17/00526; B05C 17/00546; B05C 5/02; B05C 5/0237; B05C 5/001; B05C 11/1042; B05B 15/55; B05B 7/0815; B05B 7/066; B05B 7/0416; B05B 1/044; B05B 1/042

See application file for complete search history.

(56) References Cited

U.S. PATENT DOCUMENTS

| | | | | |
|---|---|---|---|---|
| 4,951,846 | A | 8/1990 | Oster et al. | |
| 4,957,783 | A * | 9/1990 | Gabryszewski | B05B 7/0861 118/300 |
| 4,970,985 | A | 11/1990 | Slautterback | |
| 5,145,689 | A * | 9/1992 | Allen | B29C 48/345 425/72.2 |
| 5,429,840 | A * | 7/1995 | Raterman | B05B 7/0884 118/324 |
| 5,733,597 | A * | 3/1998 | Schmitkons | B05B 7/0861 118/324 |
| 6,105,832 | A | 8/2000 | Beck | |
| 6,811,095 | B2 | 11/2004 | Donley et al. | |

(Continued)

OTHER PUBLICATIONS

International Search Report and the Written Opinion of the International Searching Authority for International Application No. PCT/US2019/055806 dated Dec. 11, 2019.

*Primary Examiner* — Steven M Cernoch

(74) *Attorney, Agent, or Firm* — Warner Norcross + Judd LLP

(57) ABSTRACT

A hot melt adhesive applicator with one or more air outlets configured to direct a pressurized heated air stream transversely toward hot melt adhesive discharged through a discharge port of the applicator. A controller can switch between two modes, a discharge completion mode where the heated air stream pressure is temporarily increased to automatically eliminate or reduce hot melt adhesive stringing and an application mode where the heated air stream assists in heating or maintaining the hot melt adhesive at or above melt temperature.

17 Claims, 7 Drawing Sheets

(56) References Cited

U.S. PATENT DOCUMENTS

| | | | |
|---|---|---|---|
| 7,520,408 | B1 | 4/2009 | Smith et al. |
| 2008/0073448 | A1 | 3/2008 | Kendall |
| 2010/0051638 | A1 | 3/2010 | Riney |
| 2015/0141538 | A1 | 5/2015 | Melendy et al. |

* cited by examiner

SYSTEM, METHOD, AND APPARATUS FOR HOT MELT ADHESIVE APPLICATION

BACKGROUND OF THE INVENTION

The present invention relates generally to application of a hot applied adhesives to a substrate, and more particularly to a new and improved applicator system, method, and apparatus capable of utilizing a directed pressurized heated air stream for reducing or eliminating stringing, and/or heating of hot melt adhesive.

Hot melt adhesive applicators for dispensing hot melt adhesive, sometimes referred to as hot glue, are well known. One type of hot melt adhesive is a thermoset, and some other types of adhesive are thermoplastic. It can be provided in bulk form, as a solid cylindrical stick, or another form to be supplied to a hot melt adhesive applicator. The applicator uses a heating element to melt the adhesive, which then flows through the applicator for discharge, typically by way of pressure through a discharge port of a nozzle. The glue is tacky when hot during application, and solidifies as it cools.

One common issue with conventional hot melt adhesive applicators is that during completion of a discharge of hot melt adhesive to a substrate the hot melt adhesive can string. Stringing occurs when some of the adhesive material is left behind on the nozzle and pulled into a string. That is, when the flow of hot melt adhesive is stopped or disrupted, the hot melt adhesive tends to stretch between the substrate surface and the applicator. Stringing of hot melt adhesive can be especially troublesome because as the string cools and solidifies it lengthens and draws adhesive from both the applicator and the substrate surface. Ultimately, the stringing can result in formation of small tails or cobwebs that create a mess on the applicator and/or the substrate. A variety of different factors can contribute to and exacerbate stringing such as temperature fluctuations in the hot melt adhesive, the distance between the substrate and the applicator tip, nozzle characteristics, and environmental air flow.

Some attempts have been made to address hot melt adhesive stringing, but none of the known solutions are consistently effective, cost efficient, and simple to manufacture. One common way that stringing is addressed is by using a hot knife to cut away the string. However, this can causes problems with accumulation. Other attempts to address the issue include changing the type of hot melt adhesive, adjusting the temperature in the applicator, using a smaller nozzle or higher pump pressure to create more adhesive velocity, and replacing old hot melt hosing or other components.

One example anti-stringing applicator is described in U.S. Publication No. 2008/0073448, which teaches positioning a gas port relative to the nozzle such that glue envelops the gas port and such that the gas from the port can disrupt the flow of the glue. A low pressure steady gas flow from the gas port is used to prevent accidental back-flow up, or plugging of, the gas port. When needed, the gas flow can be increased to disrupt flow of the glue. Further, the gas can be heated to allow the use of lower gas pressure, gas flow-rate, and time. While this applicator configuration attempts to address stringing, ultimately it is unreliable and unworkable because it requires the gas port be covered in glue, which can create more issues than it solves. For example, the steady low pressure gas flow being enveloped by the hot glue can aerate or otherwise negatively affect the glue.

Another issue with some conventional hot melt adhesive applicators is clogging of the nozzle. Remnant glue left in the nozzle or near or around the tip of the nozzle can cool down and solidify disrupting and clogging the nozzle. While many applicators include a heating element to heat the nozzle thereby reheating solidified remnant hot melt adhesive, it does not always provide sufficient heat to unclog all of the glue in and around the nozzle. Instead, often the nozzle must be unclogged with a cleaning kit or in some circumstances replaced.

SUMMARY OF THE INVENTION

The present invention provides a system, method, and apparatus for dispensing fluid from an applicator on to a substrate. A heated stream of pressurized gas can be directed around the applicator. The applicator can include one or more gas outlets configured to direct the pressurized heated gas stream transversely toward fluid discharged through a discharge port. The fluid can be extruded through a nozzle toward the discharge port and the pressurized heated gas stream can be directed to a cavity in a main body supporting the nozzle such that the gas fills the cavity surrounding at least a portion of the nozzle and raises or maintains the temperature of the fluid in the nozzle.

A variety of characteristics related to the pressurized heated gas stream can be selected or varied to achieve a variety of different functions. The stream of gas can be heated via a heat exchanger. A pressurized supply of gas can be directed through a heat exchanger at a maintenance pressure level to maintain a support temperature and avoid disturbing or aerating the fluid discharged through the discharge port during application. The pressure of the heated gas stream can be temporarily increased to a blowing level sufficient to blow away remnant fluid at or around the discharge port. The pressure level of the heated gas stream can be temporarily increased to a de-stringing pressure level sufficient to prevent hot melt adhesive or other fluid stringing. The one or more gas outlets of the applicator can be configured to direct the heated gas stream toward the fluid discharged through the discharge port at a variety of different transverse angles of incidence with respect to the axis of fluid flow. At least the gas stream angle of incidence to the fluid, temperature, and pressure level can be variable or selected to provide a balance between the hot gas stream having sufficient temperature and pressure to actively prevent stringing of the fluid during completion of a fluid dispensing event, the hot gas stream having a temperature and pressure level capable of maintaining the fluid temperature in the nozzle, while ensuring the pressurized hot gas stream does not aerate or otherwise disturb fluid discharge during fluid application.

A control system can be configured to control the pressure of the gas stream via communication with a gas supply system, for example via a flow regulator. The control system can also control the discharge of fluid on to a substrate, for example via communication with a fluid supply system that supplies fluid to a nozzle assembly at a selectively variable pressure level. In some embodiments, the control system can be configured to temporarily increase the pressure level of the heated gas stream during completion of a discharge of fluid. For example, the control system can instruct the gas supply system to temporarily increase the pressure level of the hot gas stream for a predetermined amount of time in response to a reduction or stoppage in pressure level of the fluid supply system. The triggers for automation can be programmed into the logic of the controller. For example, the triggers can be time based and/or based on one or more sensor readings, if one or more sensors are included in the control system. In this way, the control system, air supply system, and fluid supply system can cooperate to provide a blast of hot gas stream transversely toward the discharged fluid at the discharge port just before (as fluid supply system pressure decreases) and just after completion of a fluid discharge event (fluid supply system pressure off). In some embodiments, the control system may instruct the fluid supply system to apply a momentary negative pressure to draw remnant fluid into the nozzle. The increase in pressure of the hot gas stream can be coordinated with this application of negative pressure to not only prevent stringing but also to assist in preventing fluid dripping or otherwise contributing to a messy nozzle or substrate.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
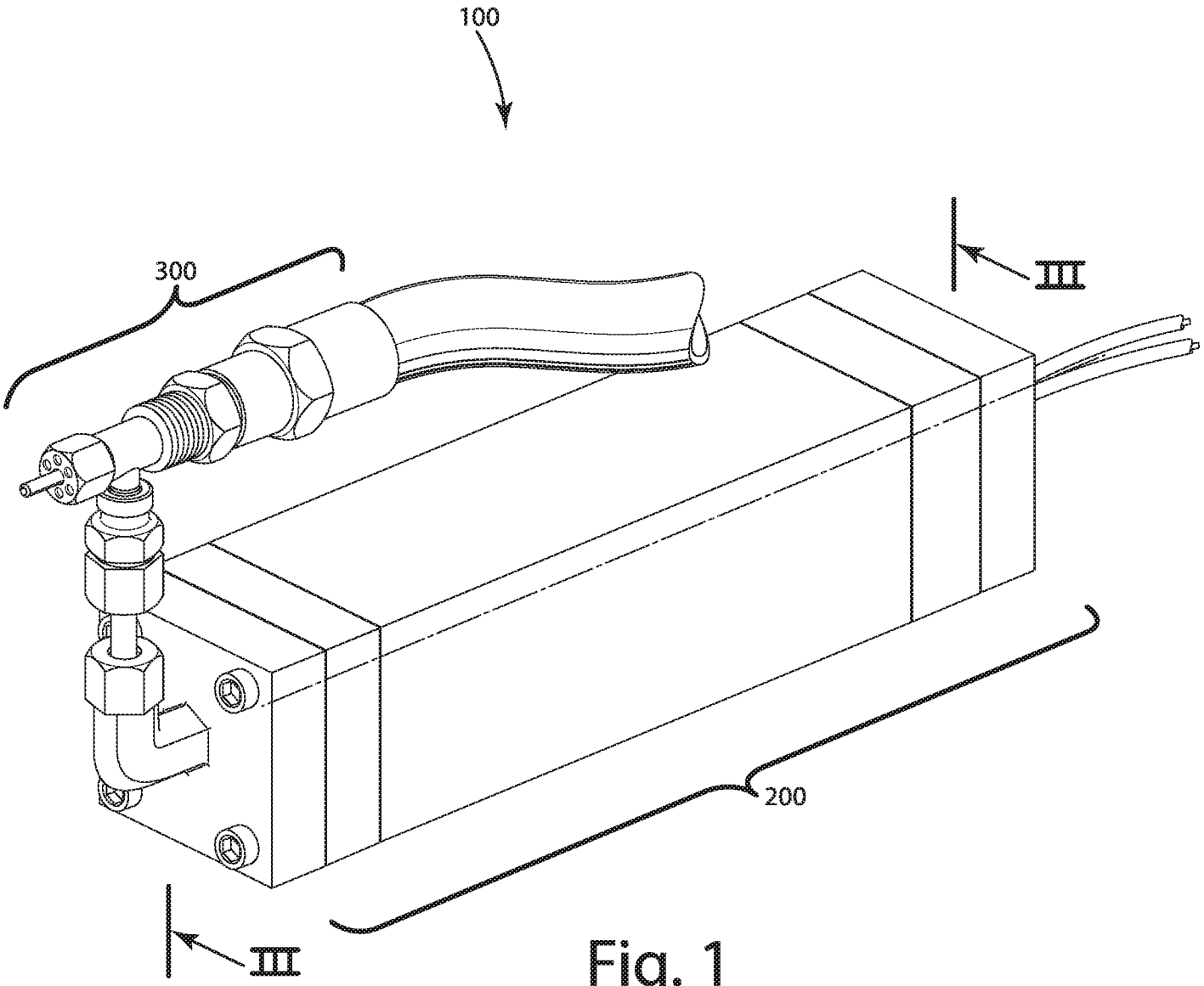
FIG. 1 illustrates a perspective view of one embodiment of a hot melt adhesive applicator.

One embodiment of a hot melt adhesive applicator is illustrated in FIG. 1, and generally designated 100. The hot melt adhesive applicator 100 generally includes a nozzle assembly 300 and a heat exchanger 200. The heat exchanger 200 supplies a heated pressurized air stream to the nozzle assembly 300. The heated air stream can provide at least two distinct functions. First, the heated air stream can assist in maintaining the temperature of the hot melt adhesive in the nozzle assembly so that it remains above the melt temperature. Second, the heated air stream can assist in keeping the discharge port of the nozzle assembly clean by blowing away remnant hot melt adhesive and preventing the hot melt adhesive from stringing during completion of a discharge of hot melt adhesive.

Figure 2:
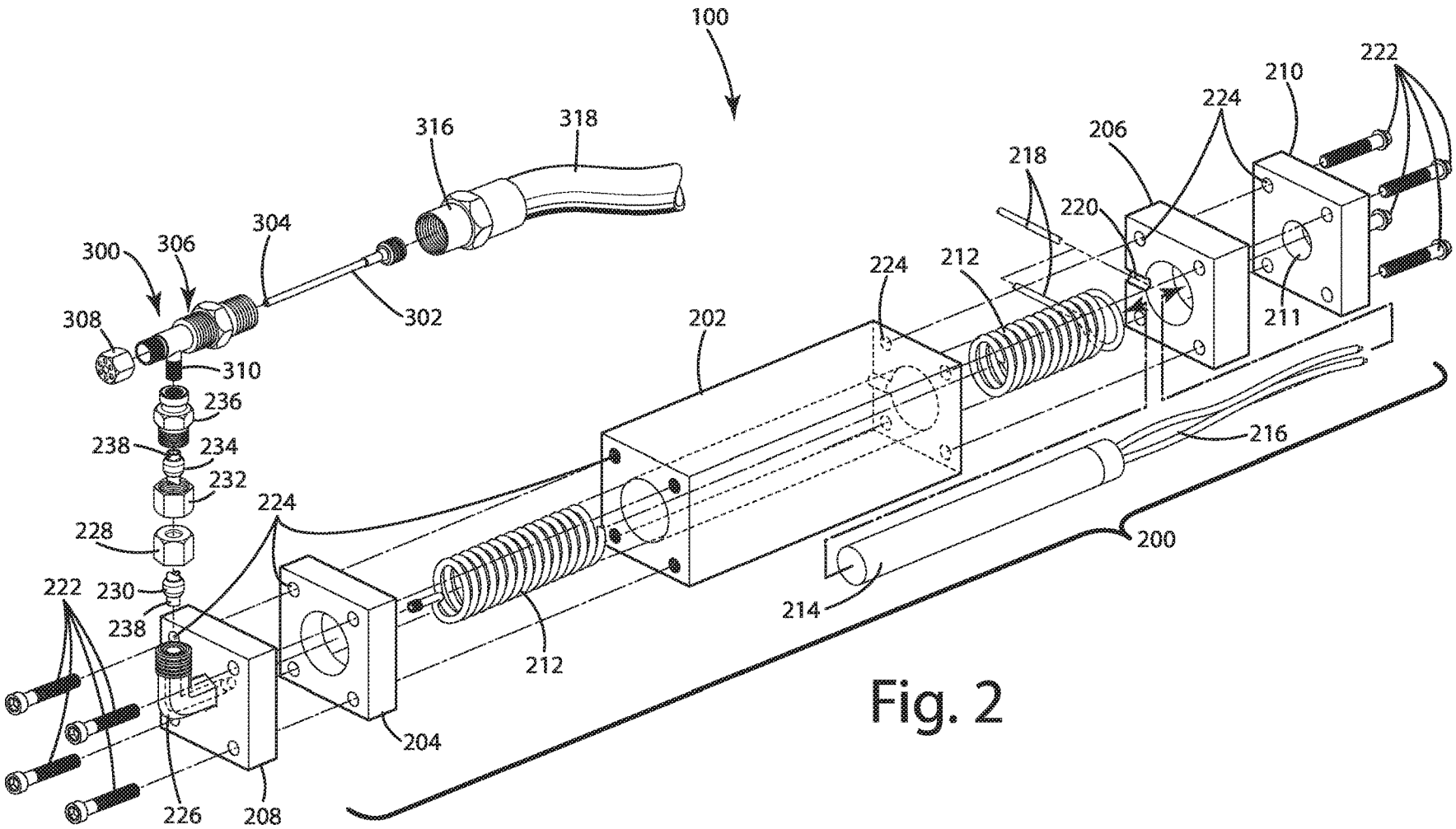
FIG. 2 illustrates an exploded view of the hot melt adhesive applicator of FIG. 1.
Figure 3:
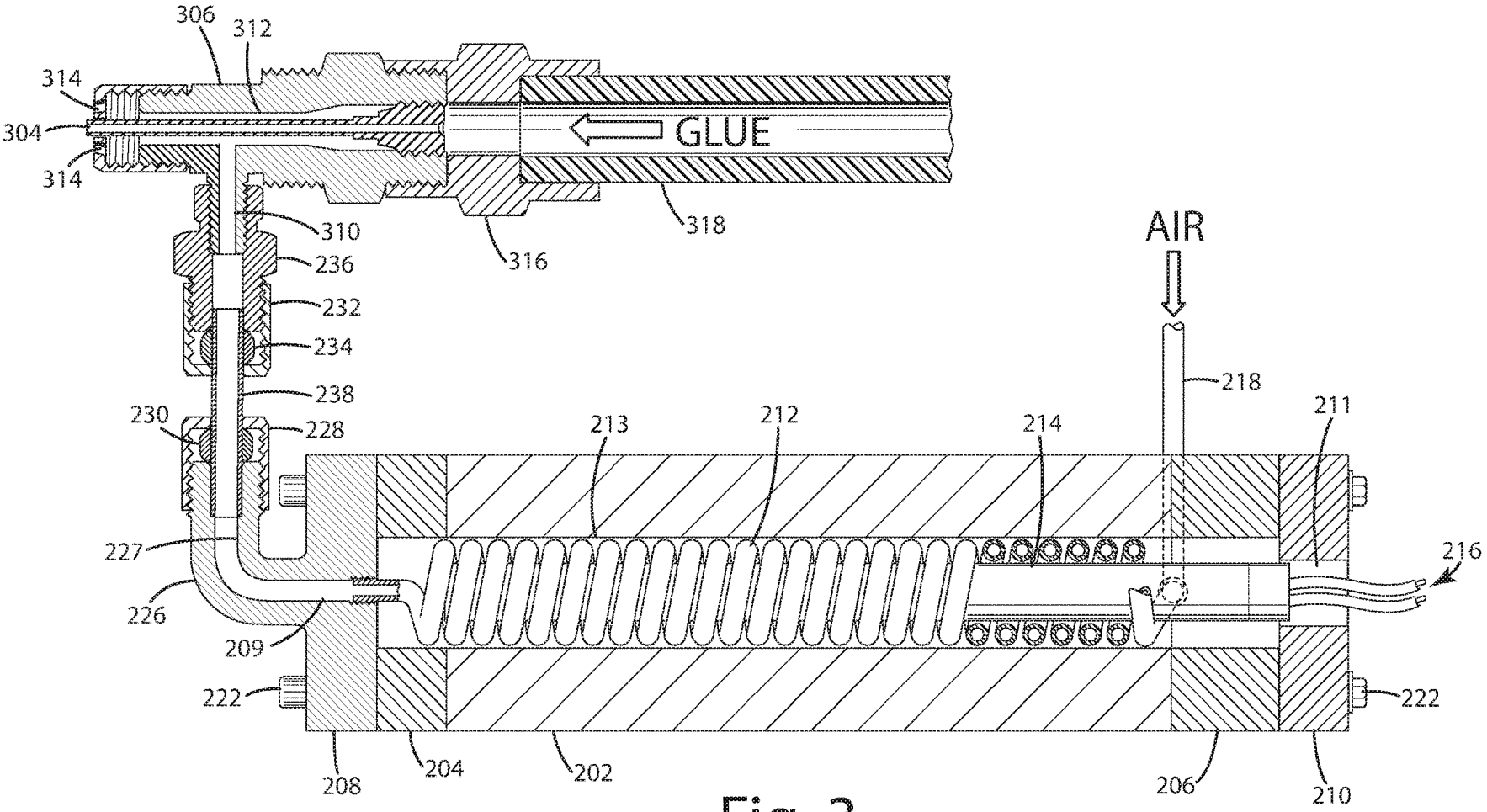
FIG. 3 illustrates a sectional view of the hot melt adhesive applicator of FIG. 1.

The hot melt adhesive applicator 100 receives a pressurized air stream, for example from an air supply system 402. The air stream can be heated by essentially any heating system. In one embodiment, the supplied pressurized stream of air is heated as it flows through a heat exchanger 200. Perhaps as best shown in FIGS. 2 and 3, the depicted embodiment of the heat exchanger 200 includes a heat exchanger body 202, a bottom spacer 204, a top spacer 206, a bottom heat exchanger cap 208, a top heat exchanger cap 210, and a heat exchanger air conduit 212 wrapped around a resistive heating element 214. In the current embodiment, the heat exchanger body 202 top spacer 206 cooperate when joined to form an air supply channel 220 for the heat exchanger air supply 218 and the top heat exchanger cap 210 includes a passageway 211 for routing the wires 216 of the resistive heater 214. In alternative constructions the air supply and wires can be routed differently. In alternative embodiments, the heat exchanger 200 may be replaced with a different type of heat transfer system that can heat the pressurized air stream. Alternatively, the applicator 100 may instead directly receive a heated pressurized air stream. Or, in yet another alternative embodiment, the applicator 100 may be configured to heat an air supply prior to pressurizing and providing the air stream to the nozzle assembly 300.

The heat exchanger body 202, spacers 204, 206, and caps 208, 210 are joined together to form a shell or housing having a cavity 213 for receiving the heat exchanger conduit 212 and the resistive heater 214. In the depicted embodiment, screws 222 join the shell components together via apertures 224. In alternative embodiments, the shell can include additional, different, or fewer components and can be configured or joined in alternative ways to provide a heat exchanger capable of heating the pressurized air stream depending on the particular desired heat characteristics. The shell components can be constructed from a variety of different materials selected to provide the heat exchanger with the desired heating characteristics. The shell components can be made of stainless steel, mild steel, brass, aluminum, or another metal. The material for the components may be selected based on maximum temperature.

In operation, the heat exchanger air supply or inlet 218 supplies a pressurized air stream to the heat exchanger 200. The air stream flows from air supply 218 to the heat exchanger conduit 212 positioned within the heat exchanger cavity 213. In the current embodiment, the heat exchanger conduit 212 is wrapped around the resistive heater 214 such that when the resistive heater is energized by supply of electricity through wires 216, the resistive heater heats up and transfers heat to the heat exchanger coil 212, which in turn transfers the heat to the air stream traveling through the heat exchanger coil 212. In the current embodiment, the heat exchanger coil 212 is a copper tube. In alternative embodiments, the heat exchanger conduit 212 can be a different material with different heat transfer characteristics. Further, the conduit 212 may be wrapped around the resistive heater in a different way or be wrapped a different number of turns than in the illustrated embodiment. In the current embodiment, the heater 214 is a 230V cartridge resistive heater capable of heating the pressurized air stream traveling through the heat exchanger coil 212 with a pressure level of 2-3 PSI to at or above 480 degrees Fahrenheit. The heat exchanger tube can be made of copper, stainless steel, aluminum, or other metal. In the current embodiment, the heat exchanger maximum temperature is about 400 degrees Fahrenheit due to the limits of the specific controller. In alternative embodiments the maximum temperature may be lower or higher. Depending on the application, the heater 214 in alternative embodiments can be replaced with a different type of heater or a resistive heater with different characteristics selected based on the application. The heater and associated electrical hardware can be selected depending on the application. For example, different components and connectors can be used to connect directly to auxiliary equipment and controllers.

The heat transfer characteristics of the heat exchanger 200 can be selected or selectively varied during operation depending on a variety of factors. For example, the pressure level of the air stream received from the air supply 218, the sizing and material of the heat exchanger conduit 212 and shell, the configuration of the conduit 212 wrapped around the resistive heater (e.g. number of turns), and the amount of heat generated by the resistive heater 214, are all variable factors that can contribute to the heat transfer characteristics of the heat exchanger. These and other factors can be adjusted to change the characteristics of the air stream. For example, by maintaining a pressure level at or below a maintenance threshold the temperature of the air stream can be maintained above a particular threshold temperature. In one embodiment, the air stream temperature is heated to and maintained at about 400 degrees Fahrenheit maximum. Many hot melt adhesives are applied at temperatures between 200 to 400 degrees Fahrenheit. Accordingly, in some embodiments the hot air stream may be heated to and maintained at a temperature within that range. The air stream target temperature may be referred to as a support temperature. The support temperature may be the target temperature of the hot melt adhesive, or it may be a temperature above or below that temperature. For example, the support temperature may be 10-20 degrees above the melt temperature of the hot melt adhesive being applied to the substrate. This higher temperature target can account for the potential decrease in temperature resulting from any temporary increase in pressure, which may also temporarily decrease the temperature of the heated air stream. Although the temperature will usually be 10-20 degrees above set material temperature, this temperature target can be varied depending on the application. By ensuring the velocity of the air stream through the heat exchanger air conduit does not exceed a particular speed, the temperature of the air stream can be maintained above a threshold temperature. At times, the air stream pressure may be increased, for example in order to prevent stringing or blow away remnant glue. In some embodiments, this temporary increase in pressure does not significantly affect the average temperature of the air stream. In other embodiments, the temporary increase in pressure can affect the temperature of the air stream and be accounted for by selection or selective variance of certain heat transfer characteristics. For example, the heat exchanger characteristics can be selectively varied to ensure that the fluctuation in temperature of the hot air stream due to this increase in pressure does not result in the hot air stream dipping below a threshold temperature, for example the melt temperature of the hot melt adhesive being applied to the substrate. In some embodiments, certain characteristics may be selectively varied to allow for a dip in temperature of the hot air stream below the threshold temperature for a pre-determined amount of time. For example, a controller that controls operation of the applicator including the pressure level of the hot air stream and the extrusion of the hot melt adhesive through the nozzle can intelligently and automatically vary the air stream pressure to ensure the temperature does not fall below a target temperature, such as the hot melt adhesive melt temperature, for longer than a pre-determined amount of time, if at all. The applicator system may also incorporate a temperature sensor for providing feedback to the controller about the temperature of the hot air stream for use in maintenance of the temperature. The temperature sensor can be positioned within or downstream from the heat exchanger 200. In the current embodiment, the sensor for the heat exchanger is in the main body and is in communication with the electric heater. In some embodiments, an additional temperature sensor may be positioned downstream from the heat exchanger 200 to sense actual exit air temperature.

The pressurized heated air stream can be fluidly communicated from the heat exchanger 200 to the nozzle assembly 300 in a variety of different ways utilizing a variety of different components. In the current embodiment, the heat exchanger conduit coil 212 is joined to a passageway 209 in the bottom heat exchanger cap 208, which is joined to a passageway 227 of an elbow air outlet 226. A pair of compression fittings, a conduit 238, and an air inlet adaptor 236 cooperate to enable a fluid communication path between the passageway 227 of the heat exchanger elbow air outlet 226 and the nozzle assembly 300. Perhaps as best shown in the FIG. 3 sectional view, the elbow air outlet 226 includes threading at a distal end. A compression collar 230 compresses as the compression nut 228 threadedly engages the elbow threading to secure the air conduit 238. An opposing compression collar 234 is secured to the nozzle assembly air inlet adaptor 236 in a similar fashion by way of a compression nut 232 threadedly engaging threads on the end of adaptor 236, which itself is threadedly secured to the air inlet 310 of the nozzle assembly 300. The compression fittings cooperate to secure the air conduit 238 providing a path for the heated pressurized air stream from the heat exchanger 200 to the nozzle assembly 300.

Figure 4:
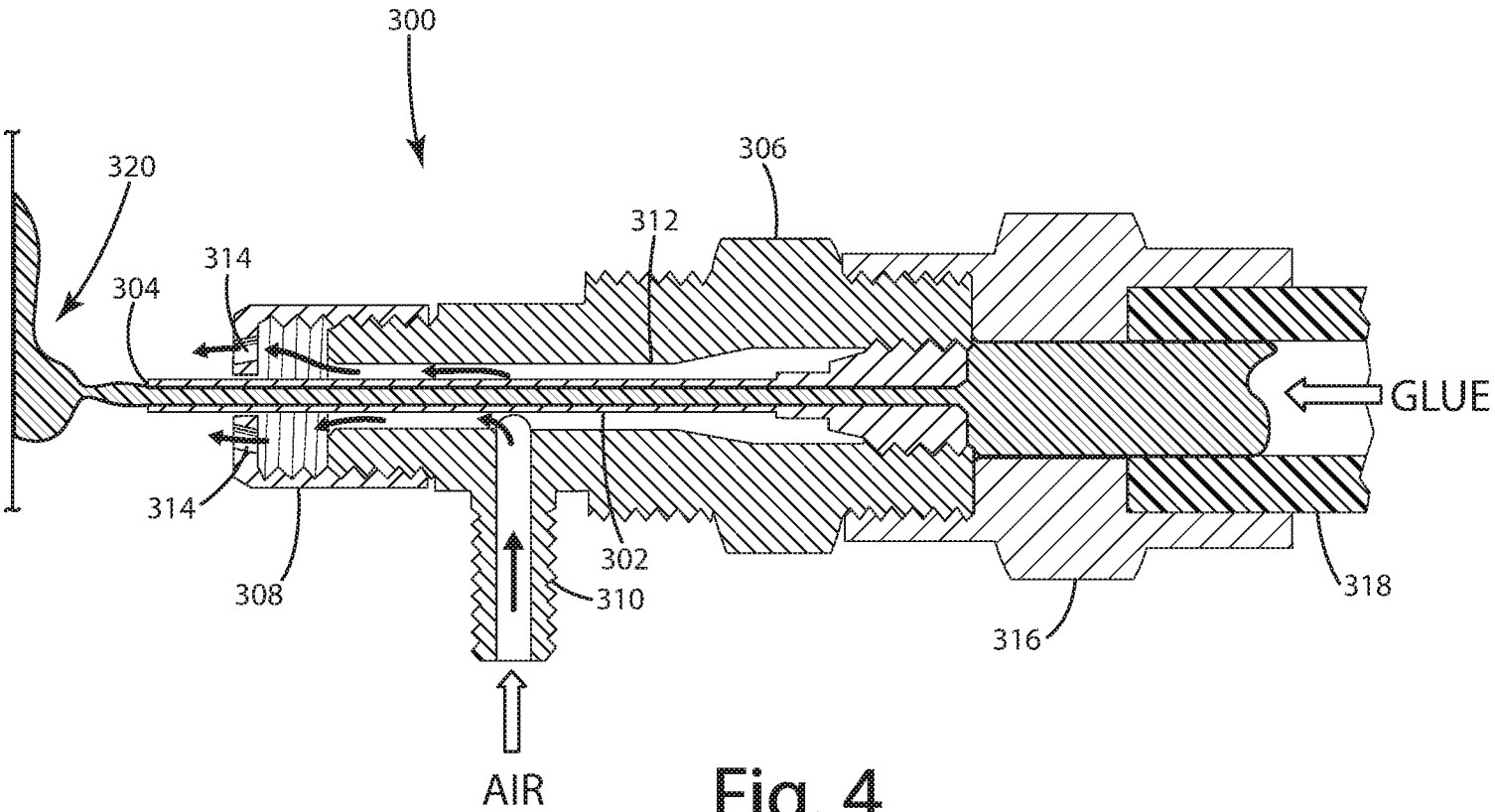
FIG. 4 illustrates a partial sectional view during operation showing the air flow path and the hot melt adhesive path through the applicator.
Figure 5:
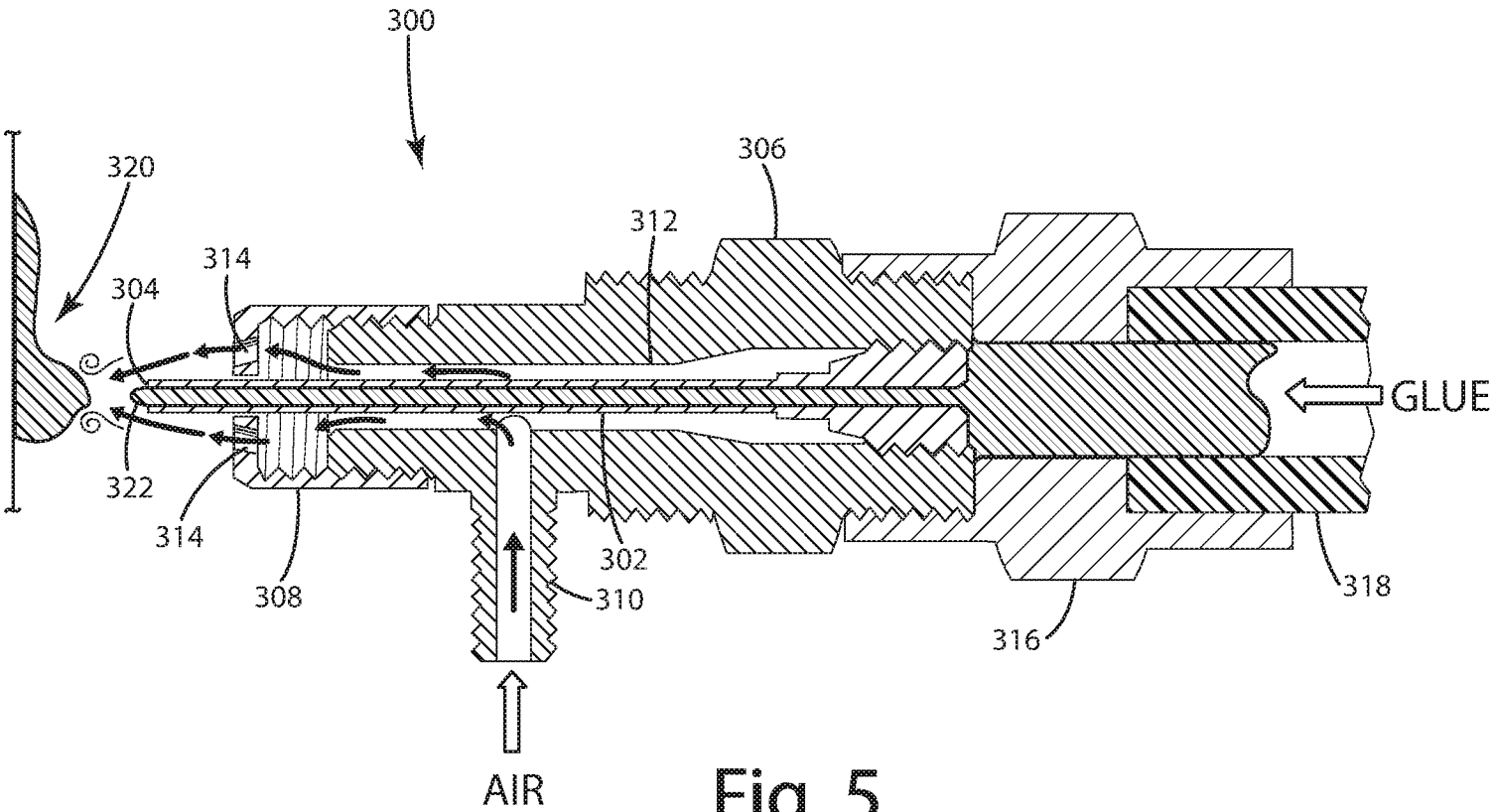
FIG. 5 illustrates a partial sectional view during completion of a hot melt adhesive discharge event showing the heated air flow path, applied hot melt adhesive, and remnant hot melt adhesive.

Perhaps as best shown in FIGS. 4-5, nozzle assembly 300 includes a nozzle 302 having a discharge port 304, main body 306, an end cap 308, an air inlet 310, a main body cavity 312, a plurality of air outlets 314, and a hot melt adhesive adaptor 316. The nozzle 302 may be threadedly secured to a nozzle retainer portion of the main body 306, as shown in FIGS. 4-5. In alternative embodiments, the nozzle 302 may be joined or integrally formed with a different nozzle assembly component. In the current embodiment, the hot melt adhesive adaptor threadedly engages threads on the proximal end of the main body 306 and the end cap 308 threadedly engages threads on the distal end of the main body 306. The nozzle extends from the proximal end of the main body cavity 312 to the distal end of the main body cavity 312 where it then projects through an aperture in the end cap 308 such that the discharge port 304 of the nozzle is located axially inside the concentrically arranged air outlets 314 in the end cap, but projects out of the distal end of the cap. In the current embodiment, the nozzle 302 extends about ¼ inch from the end cap 308. Alternative constructions may not include an end cap, and in those embodiments, the tip of the nozzle 302 can extend 1-2 MM from the main body 306 as described below. In alternative embodiments the nozzle assembly 300 may be configured with additional, different, or fewer components. For example, in one alternative embodiment instead of a one piece main body 306, the main body 306 may be an assembly from a T-fitting joined to an adaptor. As another example, instead of a nozzle assembly 300 including an end cap 308 removably secured to the main body 306, the main body 306 and end cap 308 may be a unitary construction. Hot melt adhesive can be supplied to the nozzle assembly 300 by way of a hot melt adhesive supply conduit 318 and a heated pressurized air stream can be supplied to the nozzle assembly 300 by way of air inlet 310.

As shown in FIG. 4, while hot melt adhesive 320 is extruded through nozzle 302 on to a substrate, air fills the main body cavity 312 and is directed out of the main body cavity via air outlets 314, which are arranged concentrically outside the discharge port 304 of the nozzle 302. The passageways of the air outlets 314 are configured to direct the air stream transversely toward the hot melt adhesive being discharged via the discharge port 304 of the nozzle 302. In the current embodiment, the pressure level of the air stream is kept low during a low pressure or application mode so that the heated air filling the cavity 312 raises or maintains the temperature of the hot melt adhesive in the nozzle at or above its melting point, but does not significantly disturb or aerate the hot melt adhesive as it exits the air outlets 314. In some embodiments, while in a low pressure mode the air stream does not interact or reach the discharged hot melt adhesive at the tip of the nozzle with significant enough velocity to impact the hot melt adhesive being discharged. Referring to FIG. 5, in the current embodiment, the pressure level of the air stream can be selectively increased during a high pressure or discharge completion mode so that the heated air increases its velocity and prevents stringing of the hot melt adhesive between the discharge port to the substrate by transversely cutting the string between the discharged adhesive on the substrate and the remnant hot melt adhesive in the nozzle.

While in low pressure mode, the heated air stream can help to ensure the flow characteristics of the hot melt adhesive are consistent. Further, because the needle of the nozzle 302 has a small diameter and the hot air surrounds a significant portion of the surface area of the nozzle, the temperature of the hot melt adhesive can be raised quickly upon a cold start. The In the current embodiment, toward the distal, non-tapered end, the outside diameter of the fluid nozzle is about 3/32 of an inch and the inside diameter of the main body is about 5/16 of an inch. In alternative embodiments, these diameters can vary depending on the application, for example based on fluid flow requirements. In some embodiments, the hot air stream is provided at a low, constant, pressure. The constant flow of hot air through the cavity 312 where the nozzle is located not only helps to heat the length of the nozzle but also ensures that that the tip of the nozzle that extends or projects out from the end cap 308 maintains a sufficient temperature to keep the hot melt adhesive being discharged through the discharge port consistently at or above the melt temperature. Further, by providing a low pressure, constant hot air flow of a hot air stream with a consistent high temperature, the overall temperature of the nozzle and its contents can be maintained at a consistent temperature, which can reduce leaking and stringing. A consistent temperature in some circumstances may also make it easier and cleaner to prevent stringing with a temporary blast of hot air. Further, due to the positioning and configuration of the air outlets 314 and by maintaining a relatively low PSI, for example 1-5 PSI or 2-3 PSI, the hot air stream can heat or maintain the temperature of the tip of the nozzle 302 without disturbing or aerating the hot melt adhesive during discharge.

The arrangement and configuration of the air outlets 314 urge the heated air stream from the cavity of the main body 306 transversely toward the tip of the nozzle. In the current embodiment, six air outlets concentrically surround the nozzle hole in the end cap 308. Because the air outlets 314 are arranged away from the discharge port of the nozzle the hot melt adhesive is much less prone to splatter or ooze of hot melt adhesive from the discharge port. Perhaps as best shown in FIGS. 4-5, the passageways of the air outlets are angled such that the air pathway travels along a line to intersect the hot melt adhesive just after being discharged from the discharge port 304 of the nozzle 302. As shown in FIG. 4, when in low pressure mode the air pressure results in a lower velocity heated air stream that only reaches the tip of the nozzle whereas, as shown in FIG. 5, when in high pressure mode the increase in air pressure results in a higher velocity heated air stream that extends past the tip of the nozzle discharge port 304 and provides a six stream converging heated separating force. The six separate hot air streams cooperate to essentially cut through the hot melt material 320 linked between the substrate and the hot melt material 322 near the discharge port 304. In alternative, additional or fewer separate hot air streams may be provided with a similar configuration. In the current embodiment, all of the air outlets are configured to provide the same angle of incidence between the air outlet stream path and the discharged hot melt adhesive near the discharge port 304. In alternative embodiments, the air outlets may be configured to provide different angles of incidence between the air outlet stream path and the discharged hot melt adhesive near the discharge port 304, such that the different angles of incidence further assist in providing air streams that cooperate to prevent stringing or cut strings as they form. In some embodiments, one or more slots may be provided instead of or in addition to the air outlets 314. The slot may be configured to provide a directed air stream column. For example, in one embodiment, four separate quarter slots may be provided concentrically about the nozzle aperture in the end cap 308. The diameter, shape, or width of the air outlets may be selected to provide an appropriate air stream output pressure for effectively preventing stringing or cutting strings as they are formed. In embodiments that do not include end cap 308, the stream of air can exit from the main body 360 degrees around the fluid nozzle. Alternatively, slots, slits, or holes for the stream of air may be provided integrally with the main body 306, working similarly to those described in connection with the end cap 308.

Figure 7B:
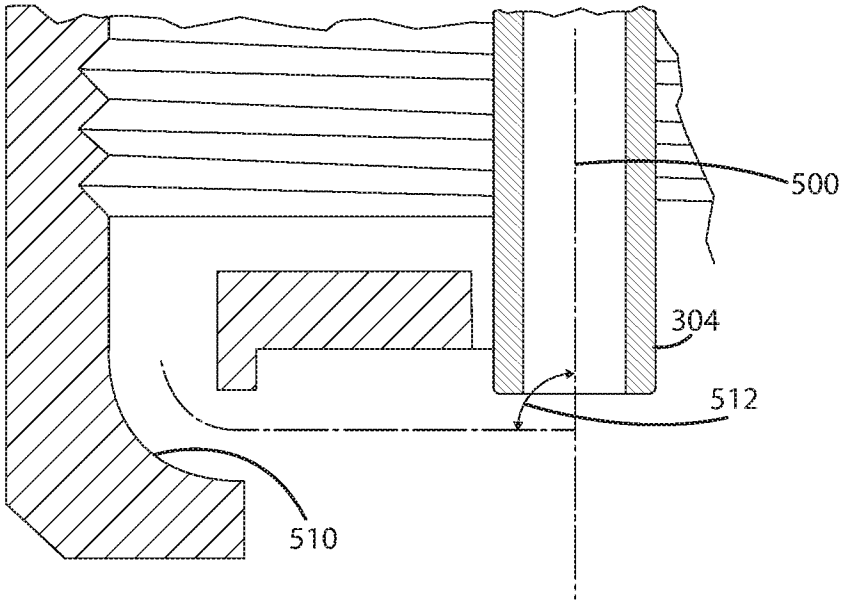
FIGS. 7A-7B illustrate exemplary air outlet configurations to direct the heated air stream toward the discharged hot melt adhesive at a variety of different angles of incidence.
Figure 7A:
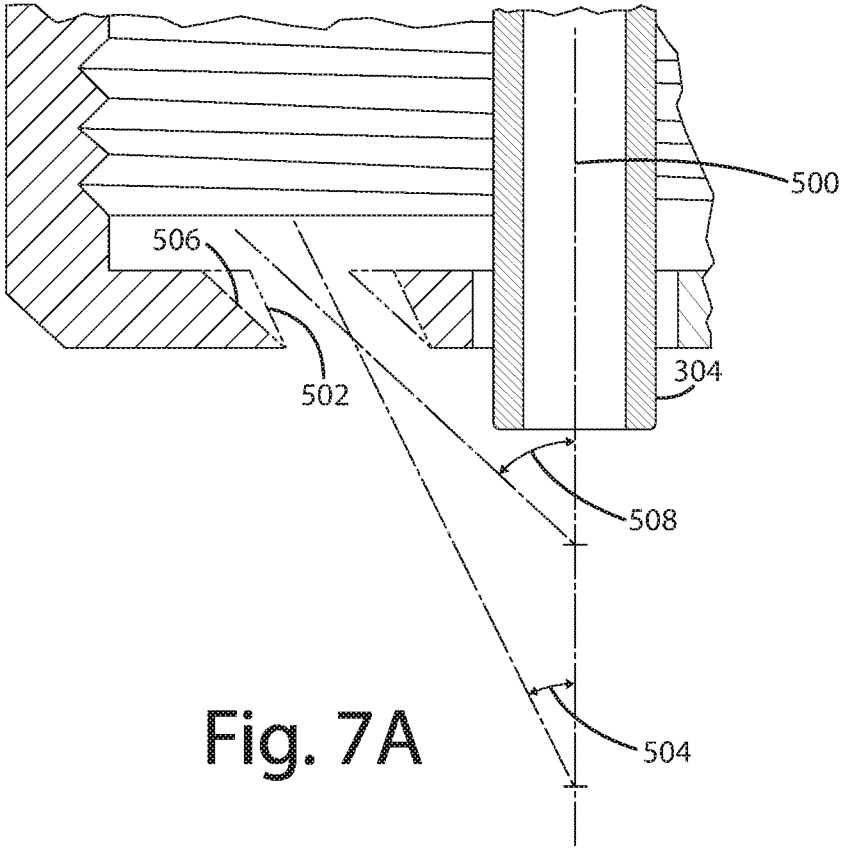

FIGS. 7A and 7B illustrate three alternative air outlet configurations. The configuration of the air outlets can be configured to provide a certain angle of incidence between the hot air stream and the hot melt adhesive discharge axis 500. FIG. 7A illustrates a first alternative air outlet configuration with a passageway 506 having an angle of incidence 508 with the hot melt adhesive discharge axis 500 of about 45 degrees. FIG. 7A also illustrates a second alternative air outlet configuration with a passageway 502 having an angle of incidence 504 with the hot melt adhesive discharge axis 500 of about 25 degrees. FIG. 7B illustrates an alternative end cap construction having an air outlet 510 that directs the heated air stream at about a 90 degree angle of incidence 512 to the hot melt discharge axis 500. In other alternative embodiments, the hot air stream can be provided at an angle of incidence within a range of about 10 degrees to 90 degrees and in some alternative embodiments with an alternative end cap construction that extends the air outlet within a range of about 90 degrees to 170 degrees.

Figure 6:
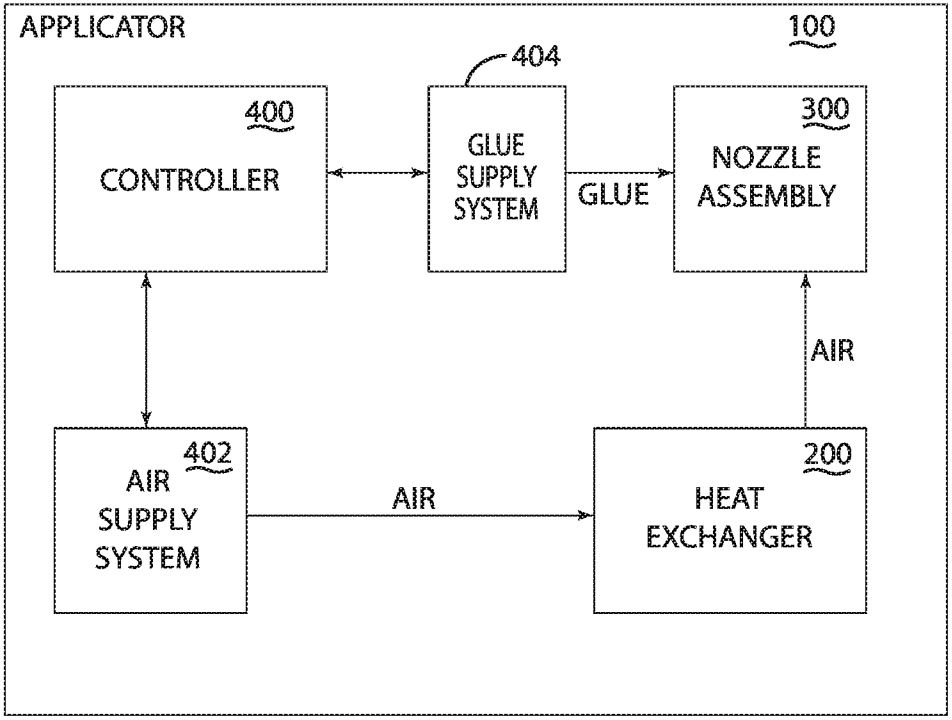
FIG. 6 illustrates one embodiment of a hot melt adhesive applicator block diagram.

Referring to FIG. 6, one embodiment of an applicator block diagram is depicted. The block diagram includes a controller 400, a glue supply system 404, the nozzle assembly 300, an air supply system 402, and a heat exchanger 200. The control system 400 can be configured to automatically or semi-automatically control the pressure of the hot air stream via communication with the air supply system, for example via a flow regulator. The control system can also control the activation and rate of discharge of hot melt adhesive dispensed on to a substrate, for example via communication with a glue supply system 404 that supplies the hot melt adhesive to the nozzle assembly at a selectively variable pressure level. In some embodiments, the control system 400 can be configured to temporarily increase the pressure level of the heated air stream during completion of a discharge of hot melt adhesive. For example, the control system 400 can instruct the air supply system 402 to temporarily increase the pressure level of the hot air stream for a predetermined amount of time in response to a reduction or stoppage in pressure level of the glue supply system. In this way, the control system 400, air supply system 402, glue supply system 404, and nozzle assembly 300 can cooperate to provide a blast of hot air stream transversely toward the discharged fluid at the discharge port just before (as glue supply system pressure decreases) and just after completion of a hot melt adhesive discharge event (glue supply system pressure off). In some embodiments, the control system may instruct the glue supply system to apply a momentary negative pressure to draw remnant fluid into the nozzle 302. The increase in pressure of the hot air stream can be coordinated with this application of negative pressure to not only prevent stringing but also to assist in preventing hot melt adhesive dripping or otherwise contributing to a messy nozzle or substrate. Further the angle of incidence of the hot air stream can be selected to facilitate the same goal. For example, an angle of incidence between 90 degrees (i.e. perpendicular to the fluid flow) and 180 degrees can be provided to blow the remnant material back into the nozzle. In another alternative embodiment, an angle of incidence between about 10 degrees and 90 degrees can be provided in a plurality of air outlets surrounding the discharge port of the nozzle such that remnant hot melt adhesive falls into the hot melt adhesive discharged on to the substrate and does not fall onto other areas of the substrate without hot melt adhesive.

In some embodiments, instead of providing a constant pressurized heated air stream with a controller that adjusts the rate of flow, the pressurized air stream can be provided intermittently as needed during completion of a discharge event in order to prevent stringing. That is, in some embodiments, the heated air stream can be activated automatically and selectively.

The applicator can be mounted to a programmable robot (not shown), for example a robotic arm. In some alternative embodiments, the applicator may be mounted in such a way that a robot can move the substrate under the nozzle. In one embodiment, a substrate travels along a conveyor belt below the hot melt applicator. The robotic arm can be programmed to actuate the hot melt applicator to apply hot melt adhesive to the substrate based on a variety of sensors or according to a program or other pre-defined sequence of operation. In one embodiment, the robotic arm may be programmed to assist in the preventing of stringing. During completion of a discharge of hot melt adhesive on to the substrate, for example in response to the controller receiving a status of, or issuing an instruction to reduce or stop application of pressure to the hot melt adhesive supply to the applicator, the robot arm can be programmed to automatically move the applicator backward slightly away from the substrate while simultaneously or sequentially increasing the pressure in the air supply system to blow off remnant hot melt adhesive and/or prevent stringing. The combination of automated air stream pressure temporarily increasing to blow off stringing and the automated backward motion of the applicator away from the substrate is a combination that can effectively keep the applicator clean by causing blown off string to consistently pile into the already applied adhesive.

The applicator system of the present invention can be utilized in connection with a variety of different fluids. For simplicity and conciseness, the current embodiment is described in connection with application of a hot melt adhesive, such as thermoset polyurethane (TPU). However, it should be understood that other, different, fluids can be utilized. For example, alternative embodiments can utilize a variety of different types of hot melt adhesive, such as ethylene-vinyl acetate (EVA), Metallocene, hot melt pressure-sensitive, adhesive (PSA), hot melt fugitive glue, amorphous poly-alpha-olefins (APAO), Polyamide or essentially any other type of hot melt adhesive. Further, in some alternative embodiments, the applicator system can be utilized with other, non-hot melt adhesive fluids.

The hot melt adhesive can be supplied to the nozzle assembly 300 by way of a variety of different supply systems at a variety of different selectable pressures and temperatures. For example, in the depicted embodiment a glue supply system 404 supplies molten hot melt adhesive to the nozzle assembly 300 of the applicator by way of conduit 318 at a pressure sufficient to extrude the hot melt adhesive through nozzle 302 and be discharged out of discharge port 304. Alternatively, a glue supply system for controlling the temperature and pressure of the hot melt adhesive supplied to the nozzle can be integral with the nozzle assembly 300.

For simplicity and conciseness, the current embodiment is described in connection with supply of a pressurized air stream, however, it should be understood that other, different, gasses could be supplied instead of air. For example, nitrogen, carbon dioxide, halogenated hydrocarbons, freons, steam, or combustion gases, to name a few, could be supplied by the gas supply system 402 instead of air.

The gas supply system 402 for providing the gas stream can vary depending on the application. The gas stream can be provided by essentially any equipment capable of providing a pressurized supply of gas. For example, some embodiments may include a compressor and/or flow or pressure regulator to achieve a selectable gas stream pressure. In alternative embodiments, the gas stream may be provided by a pressurized gas tank or cartridge, which may also be combined with a regulator to achieve a selectable gas stream pressure. The current embodiment of the air supply system 402 includes a flow regulator or other system for selectively varying the pressure of the air stream. A controller can control the air supply system. In the current embodiment, the air supply system 402 outputs an air supply 218 that may be provided to the heat exchanger 200 at a selectable pressure level, which can be controlled by way of communication between the controller 400 and air supply equipment 402. For example, the controller 400 can selectively turn the supply of air off and on at a selected air pressure, and/or the controller can selectively adjust the variable pressure level of the air supply while the air is being supplied.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A hot melt adhesive dispensing applicator comprising:

a nozzle assembly including a hot melt adhesive dispensing nozzle having a hot melt adhesive dispensing discharge port defined toward a distal end of said hot melt adhesive dispensing nozzle and wherein said nozzle assembly includes a main body including an air inlet, an air cavity surrounding a portion of said hot melt adhesive dispensing nozzle such that temperature of air within said air cavity influences flow characteristics of hot melt adhesive in said hot melt adhesive dispensing nozzle, a plurality of air outlets, and a dispensing nozzle aperture through which said distal end of said hot melt adhesive dispensing nozzle projects so as to dispense hot melt adhesive, wherein said hot melt adhesive nozzle extends through said air cavity;

a heat transfer system having a heat transfer controller, an air intake conduit and an air outlet conduit, said air outlet conduit in fluid communication with said air inlet of said main body, wherein said heat transfer system receives and heats a pressurized air stream;

wherein said air inlet of said main body is configured to direct said pressurized heated air stream into said air cavity surrounding said portion of said hot melt adhesive dispensing nozzle;

wherein said plurality of air outlets of said main body are configured to direct said pressurized heated air stream transversely toward hot melt adhesive to be discharged through said discharge port; and wherein said heat transfer controller is configured to heat said pressurized air stream to maintain at least a support temperature of said pressurized heated air stream in said air cavity surrounding said portion of said hot melt adhesive dispensing nozzle of said main body, wherein said support temperature is sufficient to both maintain said hot melt adhesive in said nozzle at or above a melt temperature of said hot melt adhesive and prevent stringing as said pressurized heated air stream is directed transversely out of the said plurality of air outlets toward hot melt adhesive to be discharged through said discharge port.

2. The hot melt adhesive dispensing applicator of claim 1 wherein the main body includes a nozzle retainer joined to an end cap.

3. The hot melt adhesive dispensing applicator of claim 1 wherein said heat transfer controller is configured to automatically control a pressure level of said pressurized air stream between a first pressure level and a second pressure level, wherein said pressure level of said heated air stream is temporarily increased from said first pressure level to said second pressure level during completion of a discharge of hot melt adhesive.

4. The hot melt adhesive dispensing applicator of claim 1 wherein said heat transfer controller is configured to pressurize said air stream at a maintenance pressure level to maintain said support temperature of said heated air stream through said heat transfer system and avoid disturbing said hot melt adhesive discharged through said discharge port during application.

5. The hot melt adhesive dispensing applicator of claim 1 wherein a pressure control system is configured to selectively pressurize said air stream through said plurality of air outlets at a blowing pressure level sufficient to blow away remnant hot melt adhesive.

6. The hot melt adhesive dispensing applicator of claim 1 wherein said heat transfer controller is configured to selectively pressurize said air stream through said plurality of air outlets at a de-stringing pressure level sufficient to sever the hot melt adhesive and prevent hot melt adhesive stringing.

7. The hot melt adhesive dispensing applicator of claim 1 wherein said plurality of air outlets are arranged concentrically outside said discharge port.

8. The hot melt adhesive dispensing applicator of claim 1 wherein at least one of said air outlets is configured to direct said pressurized heated air stream toward the hot melt adhesive discharged through the discharge port of the hot melt adhesive applicator at an angle of incidence of at least 10 degrees.

9. The hot melt adhesive dispensing applicator of claim 1 including a controller configured to temporarily increase a pressure level of the heated air stream during completion of a discharge of hot melt adhesive.

10. The hot melt adhesive dispensing applicator of claim 1 wherein said nozzle assembly includes a hot melt adhesive nozzle adaptor to which hot melt adhesive, to be dispensed, is supplied.

11. The hot melt adhesive dispensing applicator of claim 8 wherein said at least one air outlet is configured to direct said pressurized heated air stream toward the hot melt adhesive discharged through the discharge port of the hot melt adhesive applicator at an angle of incidence of 10 degrees.

12. The hot melt adhesive dispensing applicator of claim 8 wherein said at least one air outlet is configured to direct said pressurized heated air stream toward the hot melt adhesive discharged through the discharge port of the hot melt adhesive applicator at an angle of incidence of 45 degrees.

13. The hot melt adhesive dispensing applicator of claim 8 wherein said at least one air outlet is configured to direct said pressurized heated air stream toward the hot melt adhesive discharged through the discharge port of the hot melt adhesive applicator at an angle of incidence of 25 degrees.

14. The hot melt adhesive dispensing applicator of claim 8 wherein said at least one air outlet is configured to direct said pressurized heated air stream toward the hot melt adhesive discharged through the discharge port of the hot melt adhesive applicator at an angle of incidence of 90 degrees.

15. The hot melt adhesive dispensing applicator of claim 1 wherein said hot melt adhesive dispensing nozzle is defined by a needle shape and wherein said air cavity surrounds the portion of the hot melt adhesive dispensing nozzle concentrically.

16. A hot melt adhesive dispensing applicator comprising:

a nozzle assembly including a hot melt adhesive dispensing nozzle having a hot melt adhesive dispensing discharge port defined toward a distal end of said hot melt adhesive dispensing nozzle and wherein said nozzle assembly includes a main body including an air inlet, an air cavity surrounding a portion of said hot melt adhesive dispensing nozzle such that temperature of air within said air cavity influences flow characteristics of hot melt adhesive in said hot melt adhesive dispensing nozzle, a plurality of air outlets, and a dispensing nozzle aperture through which said distal end of said hot melt adhesive dispensing nozzle projects so as to dispense hot melt adhesive, wherein said hot melt adhesive dispensing nozzle extends through said air cavity;

a resistive heater having an air intake conduit and an air outlet conduit, said air outlet conduit in fluid communication with said air inlet of said main body, wherein said resistive heater receives and heats a pressurized air stream; a temperature sensor;

wherein said air inlet of said main body is configured to direct said pressurized heated air stream into said air cavity surrounding said portion of said hot melt adhesive dispensing nozzle;

wherein said plurality of air outlets of said main body are configured to direct said pressurized heated air stream transversely toward hot melt adhesive to be discharged through said discharge port; and a heat transfer controller in communication with the temperature sensor, said heat transfer controller configured to control said resistive heater to heat said pressurized air stream to maintain said support temperature of said pressurized heated air stream in said air cavity surrounding said portion of said hot melt adhesive dispensing nozzle of said main body, wherein said support temperature is sufficient to both maintain said hot melt adhesive in said nozzle at or above a melt temperature of said hot melt adhesive and prevent stringing as said pressurized heated air stream is directed transversely out of the said plurality of air outlets toward hot melt adhesive to be discharged through said discharge port.

17. The hot melt adhesive dispensing applicator of claim 16 wherein said hot melt adhesive dispensing nozzle is defined by a needle shape and wherein said air cavity surrounds the portion of the hot melt adhesive dispensing nozzle concentrically.

* * * * *